US005192005A

United States Patent [19]

Zimmerman

[11] Patent Number: 5,192,005

[45] Date of Patent: Mar. 9, 1993

[54] CONDIMENT SHAKER

[75] Inventor: Larry G. Zimmerman, Champaign, Ill.

[73] Assignee: Dart Industries Inc., Deerfield, Ill.

[21] Appl. No.: 739,264

[22] Filed: Aug. 1, 1991

[51] Int. Cl.[5] ..... B65D 47/00

[52] U.S. Cl. ..... 222/148; 222/534; 222/556; 222/565; 220/338; 215/237

[58] Field of Search ..... 222/148, 196.1, 196.2, 222/196.3, 480, 533, 534, 536, 556, 565; 215/237; 220/282, 338

[56] References Cited

U.S. PATENT DOCUMENTS

| | | | |
|---|---|---|---|
| 1,033,688 | 7/1912 | Fuchs | 222/142.1 |
| 1,033,689 | 7/1912 | Fuchs | 222/142.1 |
| 1,102,302 | 7/1914 | Slade | 222/196.3 |
| 1,666,743 | 1/1916 | Cochran | 222/196.3 |
| 2,361,958 | 11/1944 | Nyden | 222/556 |
| 2,474,678 | 6/1949 | Kitchen | 222/148 |
| 2,484,148 | 10/1949 | Beatty et al. | 222/196.2 |
| 3,131,824 | 5/1964 | Van Baarn | 222/151 |
| 3,302,835 | 2/1967 | Eckles | 222/565 |
| 3,303,971 | 2/1967 | Stevens, Jr. | 222/534 |
| 3,383,019 | 5/1968 | Waterman | 222/565 |
| 3,542,256 | 11/1970 | Waterman | 222/536 X |
| 3,675,812 | 7/1972 | Foster | 222/565 X |
| 4,487,342 | 12/1984 | Shy | 222/534 X |
| 4,776,501 | 10/1988 | Ostrowsky | 222/556 X |
| 5,022,566 | 6/1991 | Song et al. | 222/556 X |
| 5,065,912 | 11/1991 | Rosenthal | 222/534 X |

FOREIGN PATENT DOCUMENTS

| | | | |
|---|---|---|---|
| 2609000 | 7/1988 | France | 222/480 |

*Primary Examiner*—Andres Kashnikow
*Assistant Examiner*—Anthoula Pomrening
*Attorney, Agent, or Firm*—John A. Doninger

[57] ABSTRACT

A condiment shaker including a hollow body with an enlarged opening therethrough receiving a pivotally mounted lid for rocking between a closed position and a dispensing position. In the dispensing position, slots through the lid flange are open and provide transverse dispensing passages. Lugs on the container body align with the slots and move through the length thereof as the lid is closed. The lid is positively positioned and releasably retained in each of the two positions by cooperating abutment areas and a complementary protuberance and recess respectively on the container body and the lid.

22 Claims, 2 Drawing Sheets

FIG. 6
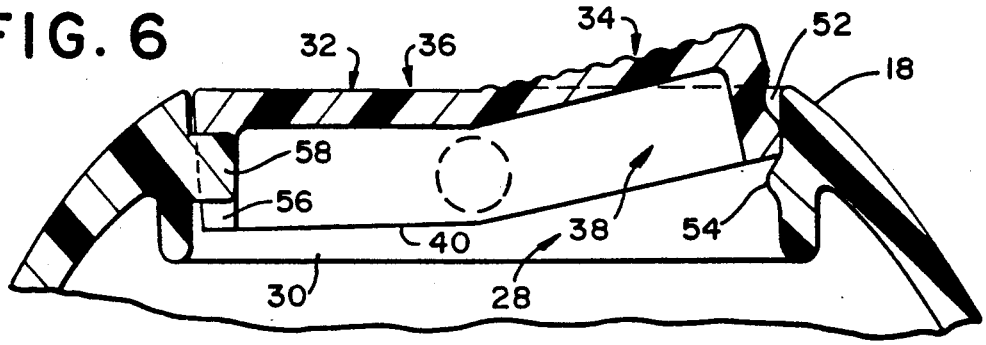
FIG. 7
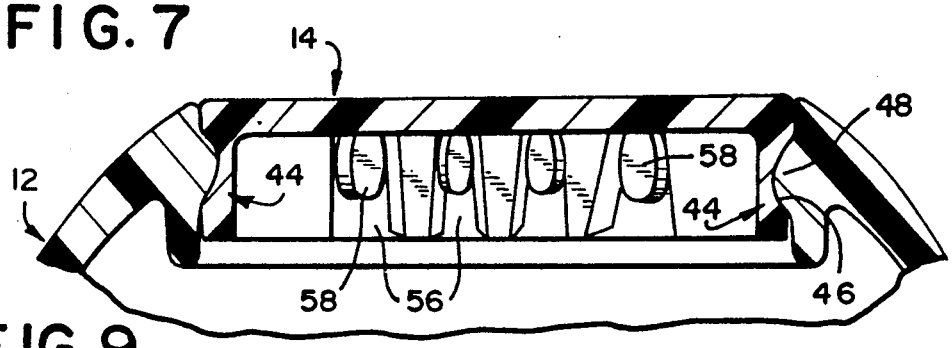
FIG. 9
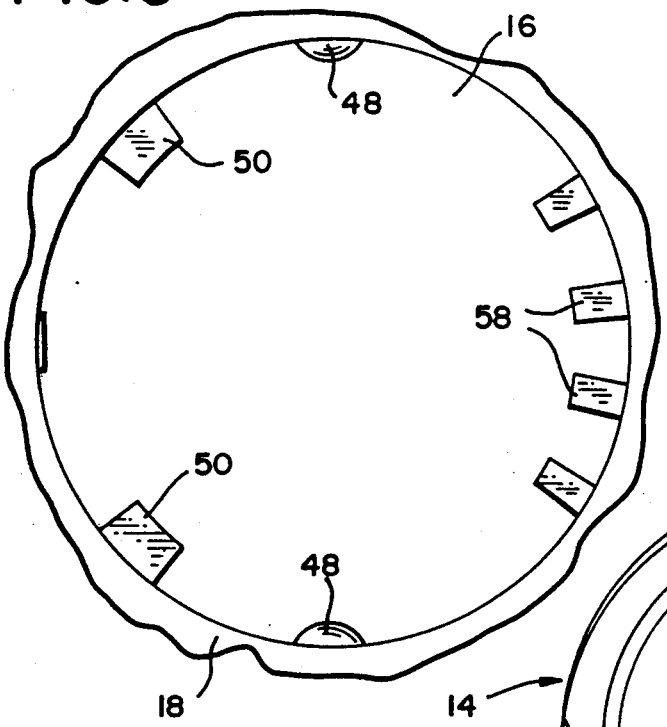
FIG. 8
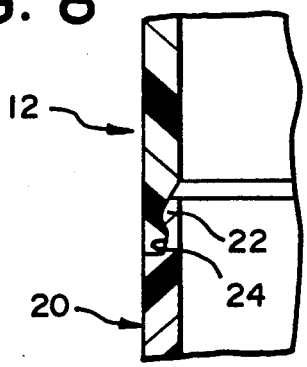
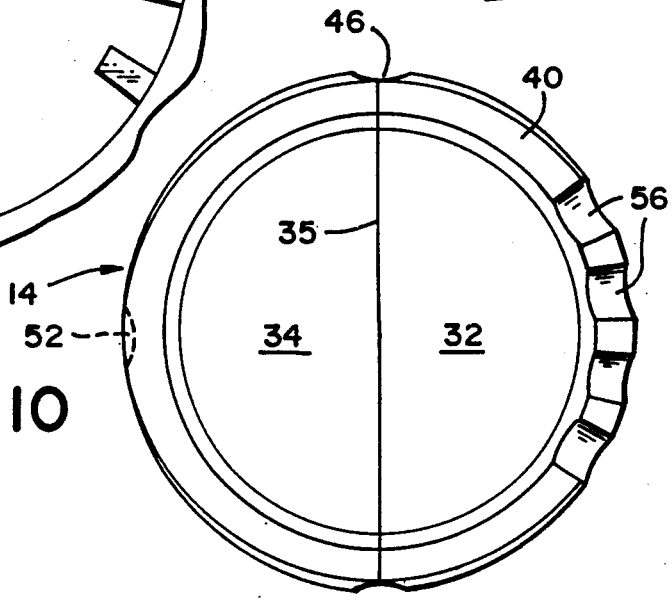
FIG. 10

CONDIMENT SHAKER

BACKGROUND OF THE INVENTION

Shakers for granular condiments, for example salt and pepper, basically comprise a hollow container with multiple apertures therein for the selective dispensing of the condiment upon a shaking of the container. The apertures will frequently be provided in a removable cover which also functions as a means for filling the container.

Because of the tendency for granules of salt, pepper, and the like to adhere to each other and clog the shaker apertures, particularly under conditions of high humidity, it has in the past been proposed to provide means for maintaining a free flow of the contents from the shaker. Such means include covers for the shaker apertures, rigid means which are selectively extended through the shaker apertures for a periodic cleaning thereof, and combination means which simultaneously cover and clean the apertures.

The known means for maintaining the integrity of shaker apertures, while usually effective for their intended purpose, are frequently awkward to manipulate, requiring, as an example, the use of two hands for a removal of a cover. In other instances, the shaker, during use, must be held in a particular manner to ensure a retraction of the cover and/or projections as the condiment is dispensed. In yet other instances the protective means is intended to be self-retracting, a system which relies on free sliding movement of the cover element. Such a system can be easily interfered with by the shaker contents, particularly should there be any tendency for the granular material to adhere to itself or to the sliding elements.

SUMMARY OF THE INVENTION

The present invention involves a shaker for salt, pepper, and the like which includes a cover or lid for the container with the discharge apertures defined laterally through the lid for a controlled side discharge of the condiment.

The lid is mounted for movement between a discharge position and a closed position and conveniently manipulated by a single finger of the one hand holding the shaker. The lid is, independently of finger pressure, releasably retained in each of its two positions, allowing unencumbered manipulation of the shaker.

The cover projects above and disrupts the smooth exterior surface of the body only sufficiently to expose the laterally directed discharge apertures or, when closed, to only present a small pressure section or pad.

The discharge apertures, defined through the lid itself, are self-cleaning in conjunction with a rocking movement of the lid between the dispensing and closed positions through engagement with cooperating lugs mounted on the body and fixed relative to the moving lid.

Structurally, the shaker includes a vertically elongate cylindrical body with a generally domed upper end having a circular opening therethrough. The opening includes a peripheral wall depending into the interior of the body. The lid is circular and received within the opening, mounting upon a pair of diametrically opposed pivots formed by mating snap-interengaging projections and recesses. The lid includes a top panel with two semi-circular sections at an obtuse angle to each other to the opposite sides of the pivot line with the two sections presenting upper surfaces selectively substantially in the plane of the top of the body respectively in the open dispensing position of the lid and the closed position thereof.

The lid includes a depending peripheral flange which is received within and in sufficiently close proximity to the opening wall as to preclude passage of the contained condiment therebetween. The lower or inner edge of the flange is in two planar sections paralleling the top panel. One of these edge sections has vertical or transverse slots extending inwardly therethrough and for a substantial portion of the width of the lid flange whereby, upon a vertical or outward exposure of this portion of the flange, lateral discharge apertures are defined outward of the shaker body. The wall of the shaker opening includes laterally extending lugs which align with the lid slots and selectively engage therein as the lid is pivoted closed, and withdraw therefrom as the lid is pivoted open, thus effectively clearing the slots. In the closed position of the lid, the lugs engage at the inner extent of the slots to position the lid. Detent means between the lid flange and the opening wall releasably retain the lid in the closed position. This detent means similarly retains the lid in its open position which is in turn defined by inwardly projecting shoulders on the opening wall against which the inner edge of the flange, to the opposite side of the pivot line from the discharge slots, engages.

Additional structural features of the invention, and specific advantages derived therefrom, will become apparent from the more complete description of the invention following hereinafter.

BRIEF DESCRIPTION OF THE DRAWINGS

FIG. 6 is an enlarged cross-sectional detail taken substantially on a plane passing along line 6—6 in FIG. 2;

FIG. 7 is an enlarged cross-sectional detail taken substantially on a plane passing along line 7—7 in FIG. 2;

FIG. 8 is an enlarged cross-sectional detail taken substantially on a plane passing along line 8—8 in FIG. 1;

FIG. 9 is an enlarged plan view of the container opening within which the lid mounts; and FIG. 10 is an enlarged bottom plan view of the lid.

DESCRIPTION OF PREFERRED EMBODIMENTS

Figure 1:
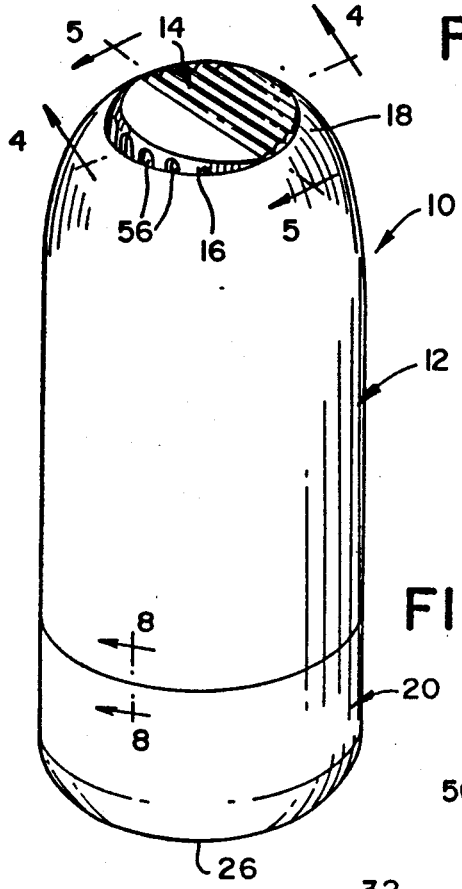
FIG. 1 is a perspective view of the condiment shaker with the lid in the dispensing position.

Referring now more specifically to the drawings, the shaker 10 comprises a hollow vertically elongate and preferably cylindrical body 12. The body 12 defines a container for the condiment, for example salt or pepper, to be stored and selectively dispensed through a dispensing lid 14 mounted within an enlarged central opening 16 in the slightly domed upper end 18 of the body 12.

In order to introduce the condiments into the body 12, it is preferred that the lower approximately 25% of the body be formed as a separate base 20 which snap locks to the main portion of the body through internesting ribs 22 and grooves 24 defined within the walls of the two parts of the body and presenting smooth exterior and interior body surfaces, all as best seen in the sectional detail of FIG. 8. The base 20 will have a flat bottom surface 26 in order to stand the shaker 10 upright. It is preferred that the main upper portion of the body 12 be opaque or translucent, providing in effect a decorative surface appearance. The base 20 is preferably transparent to provide an immediate visual indication of both the nature of the condiment in the container and whether a resupplying of the container is necessary.

The body opening 16 is surrounded by a peripheral wall 28 integrally formed with the body and extending vertically inward thereof, terminating in an inner edge 30. The opening 16 and the peripheral wall 28 thereof are preferably circular in plan, with the lid 14 being of a complementary configuration for close although movable reception within the opening 16 and opening wall 28 whereby a sealing of the opening against accidental discharge of condiments is achieved while at the same time allowing for an adjustment of the lid for the selected dispensing of the condiments, as shall be explained subsequently.

The lid 14, molded in one piece, is in the nature of a rocking lid and includes two equal size sections, a dispensing section 32 and a pressure section 34, both, in the case of a circular lid, being semi-circular in plan. The lid sections are angularly related to each other and define a pivot line therebetween diametrically across the lid and generally coincident with the visible angle line 35 formed between the angularly related component parts of the lid sections and best seen in FIG. 10. Each of the lid sections respectively extends at an angle of approximately 7.5 degrees from the plane of the other section whereby a low obtuse angle is formed between the sections as will be best seen in FIGS. 3 and 4.

The lid 14 includes a circular top panel 36 and a depending peripheral flange 38 which terminates in a lower or inner edge 40. The top panel 36, and the upper and lower generally parallel surfaces thereof, follow the angular orientation of the lid sections 32 and 34 relative to each other, as does the depending or inwardly directed peripheral flange 38 which is of a constant width or height. The inner edge 40 of the flange parallels the undersurface of the lid panel 36 and includes two lengths which also follow said angular orientation.

Figure 3:
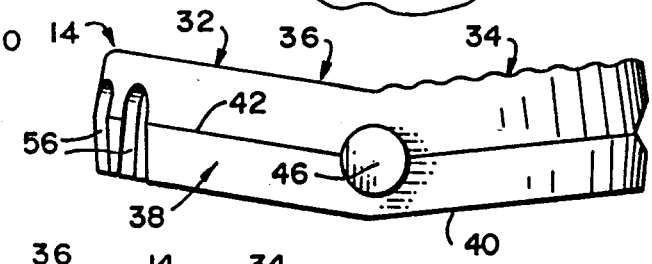
FIG. 3 is a side elevational view of the lid removed from the shaker.

Noting FIG. 3 in particular, the exterior surface of the flange 38 is slightly inwardly tapered from a mid-height line 42 to provide slight clearance at the upper and lower extremities of the outer periphery of the lid 14 for facilitating the desired pivotal rocking and sealing of the lid.

The lid 14 is a rocking lid and mounts between a pair of diametrically opposed pivots 44 on the pivot line for rocking movement between an open dispensing position and a closed sealed position. Each of the pivots 44 comprises a concave socket 46 formed within the outer surface of the lid flange 38, and a mating convex protuberance 48 projecting radially inward from the wall 28 surrounding the opening 16. The pivots 44 are so located relative to the respective heights of the lid flange 38 and opening wall 28 as to, upon a pivoting of the lid 14, alternately position the upper face of the top panel portions of the pressure section and the dispensing section to lie substantially within the plane of the exterior of the top or upper portion of the shaker body 12. This relationship will be best noted in FIGS. 1 and 2, and FIGS. 4 and 6.

Figure 4:
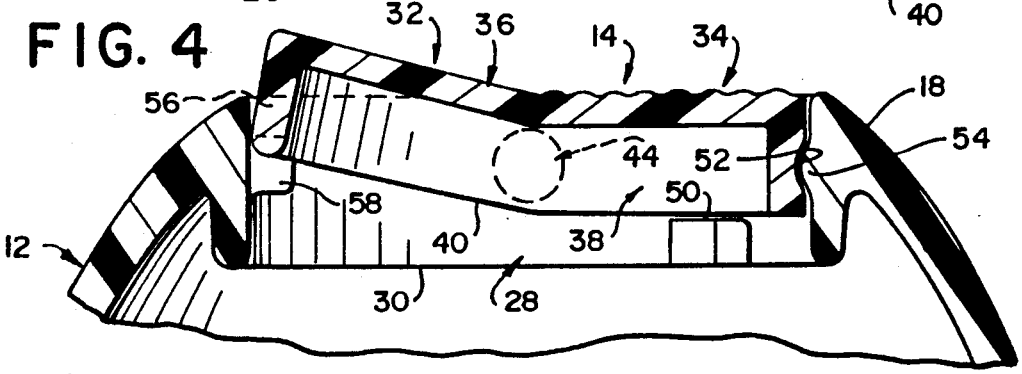
FIG. 4 is an enlarged cross-sectional detail taken substantially on a plane passing along line 4—4 in FIG. 1.
Figure 5:
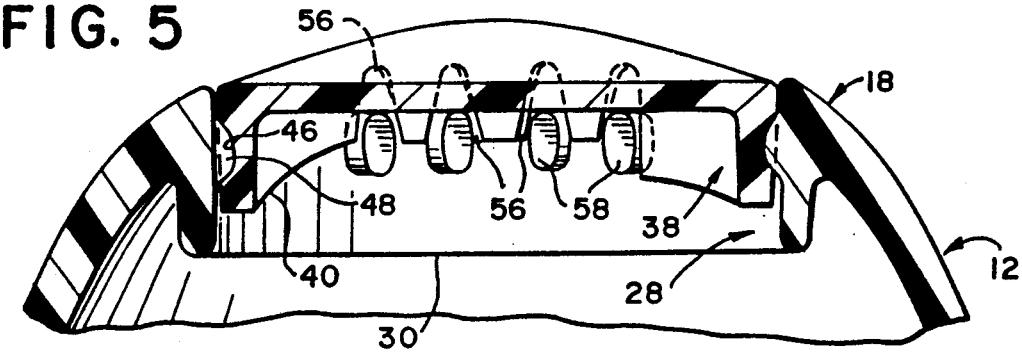
FIG. 5 is an enlarged cross-sectional detail taken substantially on a plane passing along line 5—5 in FIG. 1.

In the open or dispensing position of the lid 14, noting FIGS. 1 and 4 in particular, the pressure section 34 is, in a vertical shaker as illustrated, horizontally oriented with the upper surface of the top panel portion being generally planar with the top 18 of the shaker body 12. This upper surface may, as suggested in the drawings, include a roughened area, for example low rise transverse ribs, to provide a tactile indication of the pressure section for distinguishing the sections by touch as well as by appearance for an immediate indication of the position of the lid.

In this open or dispensing position of the lid 14, the lower edge 40 of the flange 38 within the pressure section 34 and spaced from the pivots 44 rests on positioning shoulders 50 defined by integral inwardly extending projections on the opening wall 28. The lid is retained in this position by a recess or concavity 52 in the outer surface of the lid flange 38 at 90° from the pivot line for releasable "snapping" engagement of a complementary protrusion 54 on the opening wall 28 therein. The recess and protuberance 52 and 54 comprise releasable retaining means while the shoulders 50 define positioning means to both position and releasably retain the lid 14 in its dispensing position.

The actual dispensing is effected through a series of dispensing slots 56 in a portion of the lid flange 38 in the dispensing section spaced along an arc generally diametrically opposed from the retaining means 52, 54 and at right angles to the pivot line. These slots extend tranversely or vertically through the lower or inner edge 40 of the flange 38 and terminate below the top panel 36. The length of the dispensing slots 56 is such whereby, in the dispensing position of the lid 14, a sufficient portion of the slots is exposed above the top of the shaker body 12 as to define through passages for a discharge of condiments from the interior of the shaker using a conventional "shaking" motion. As can be appreciated, the configuration, and more particularly the size of the slots can vary in accord with the particular condiments involved.

Figure 2:
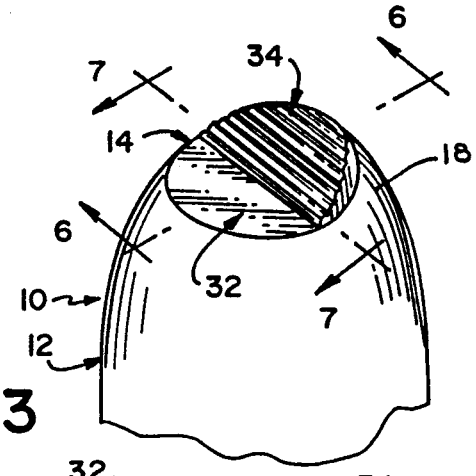
FIG. 2 is a perspective view of the upper portion of the shaker with the lid in its closed position.

The slots 56, terminating below or inward of the top panel of the lid, are completely concealed and sealed in the closed position of the lid, noting FIGS. 2 and 6, thus both preventing accidental spillage of the shaker contents and providing means for protecting the condiments from excess humidity, and the like. The height of the lid flange 38 is such whereby the inner edge 40 thereof remains inward of the exterior of the body in both the dispensing and closed positions.

A series of lugs 58 are integrally formed with and project radially inward from the opening wall 28, one in alignment with each of said slots 56. Noting FIGS. 4–7, the lugs project inwardly sufficiently to extend completely through the corresponding slots, and are so located on the wall 28, relative to the slots, as to, in the dispensing position, extend below or inward of the open inner ends of the slots so a to completely retract from the formed dispensing through passages. In the closed position of the lid, the slots move downwardly over the lugs 58 with the upper closed ends of the slots engaging the upper ends of the lugs which define positioning means for positioning the lid 14 in its closed position with the upper surface of the dispensing section substantially planar with the exterior of the shaker body 12 at the upper end 18 thereof. The full range of movement of the lugs and slots relative to each other provide for an effective means for automatically cleaning and clearing the slots 56, and hence the through passages formed thereby in the dispensing position, in response to a pivotal rocking of the lid between its two positions.

Noting FIG. 6 in particular, the protuberance 54 which, in conjunction with the recess 52 form a retaining means for retaining the lid in its dispensing position, also cooperates with the lower edge 40 of the lid flange immediately aligned therewith for a retention of the lid in its closed position. In other words, the aligned portion of the lower edge 40 seats on the upper portion of the protuberance 54, providing a resistance, easily overcome by direct finger pressure, to movement of the lid from the closed position.

As previously noted, the exterior of the lid flange 38 is so configured as to allow for the desired rocking movement without excess interference with the opening wall 28, while at the same time providing for an effective sealing of the opening peripherally thereabout, particularly in the closed position of the lid. Close tolerance is also of course desired in the dispensing position to ensure that the actual dispensing is solely through the slot-formed through passages.

The lid and at least the major upper portion of the shaker body are preferably formed of polypropylene and include sufficient resilient flexibility to allow for the rocking adjustment of the lid and the "snap" retention thereof in the two positions. The removable transparent lower section of the container body may be formed of an appropriate polycarbonate.

The shaker, and in particular the hollow body and rocking lid, form a unique combination providing multiple advantages, including self-cleaning dispensing slots, means both visual and tactile for immediately ascertaining the position of the dispensing lid, means for automatically positioning an retaining the lid in the two positions thereof, and the like, all of which contribute to the practicality of the shaker and the capability of the shaker to be used in the manner of a conventional shaker notwithstanding the unique features thereof.

The foregoing is considered illustrative of the principles of the invention. Other embodiments and modifications may occur to those skilled in the art, and as such, it is not desired to limit the invention to the exact construction and manner of use as shown and described. Rather, the invention is to only be limited by the scope of the claims following hereinafter.

I claim:

1. A condiment shaker comprising a hollow body adapted to contain a condiment for selective dispensing thereof, an opening defined through said body, wall means peripherally encircling said opening, a lid for said opening received within said wall means, said lid including a top panel generally coextensive with said opening, and a peripheral flange depending from said top panel and terminating in an inner edge, said peripheral flange being received within said wall means in sufficiently close peripheral proximity thereto to substantially preclude discharge of shaker contents therebetween, said lid including a dispensing section and a pressure section extending from said dispensing section and defining a pivot line therebetween, a first portion of said lid flange, within said dispensing section, including dispensing slot means defined therein and extending transversely between said inner edge and said top panel, and pivot means mounting said lid in said opening for pivotal movement along said pivot line of said lid between a dispensing position and a closed position; said dispensing slot means in said dispensing position of said lid being positioned at least partially outward of said hollow body and said opening wall means and defining a through passage outward from said hollow body to the exterior of said hollow body for a dispensing of a condiment therefrom, said lid flange peripherally beyond said first portion being in substantially sealed engagement with said opening wall means; said dispensing slot means in said closed position of said lid being positioned within said opening and in transverse alignment with a corresponding portion of said opening wall means to preclude dispensing through said slot means.

2. The condiment shaker of claim 1 wherein said slot means open through said inner edge of said lid flange, and lug means on and projecting inwardly from said opening wall means in alignment with said slot means, said slot means receiving said lug means therein in said closed position of said lid, and retracting from said lug means in said dispensing position.

3. The condiment shaker of claim 2 including retaining means for retaining said lid in each of said dispensing and closed positions.

4. The condiment shaker of claim 3 including positioning means for locating said lid in each of said dispensing and closed positions.

5. The condiment shaker of claim 4 wherein said inner edge of said lid flange includes first and second lengths respectively substantially coextensive with said dispensing and pressure sections, said edge lengths extending from said pivot line respectively at an acute angle from the plane of the other edge length.

6. The condiment shaker of claim 5 wherein said slot means comprise a plurality of peripherally spaced slots extending across a major portion of the width of said flange between said flange inner edge and said top panel, said lug means comprising multiple projecting lugs, one aligned with and receivable within each of said slots.

7. The condiment shaker of claim 6 wherein each of said slots includes a closed end remote from said flange inner edge and adjacent said top panel, said lugs, in said closed position of said lid, engaging said closed ends and defining said positioning means for locating said lid in said closed position.

8. The condiment shaker of claim 7 wherein said positioning means for locating said lid in said dispensing position comprises inwardly projecting shoulder means on said opening wall means for engagement with said flange inner edge thereon in said dispensing position.

9. The condiment shaker of claim 8 wherein said retaining means comprises a recess and an aligned complementary projection, one on said flange and one on said wall means, said projection being releasably received in said recess in said dispensing position and thereby defining said retaining means for selectively retaining said lid in said dispensing position.

10. The condiment shaker of claim 9 wherein said projection is on said wall means, a portion of said inner edge of said flange aligning with said projection and engaging thereon in said closed position to define said retaining means for selectively retaining said lid in said closed position.

11. The condiment shaker of claim 10 wherein said pivot means comprises a pair of pivots on said pivot line at diametrically opposed sides of said lid, each pivot comprising a recess and a complementary projection rotatably received therein, one on said flange and one on said wall means.

12. The condiment shaker of claim 2 wherein said slot means comprise a plurality of peripherally spaced slots extending across a major portion of the width of said flange between said flange inner edge and said top panel, said lug means comprising multiple projecting lugs, one aligned with and receivable within each of said slots.

13. The condiment shaker of claim 12 wherein each of said slots includes a closed end remote from said flange inner edge and adjacent said top panel, said lugs, in said closed position of said lid, engaging said closed ends and defining positioning means for locating said lid in said closed position.

14. The condiment shaker of claim 1 including positioning means for locating said lid in each of said dispensing and closed positions, said positioning means for locating said lid in said dispensing position comprising inwardly projecting shoulder means on said opening wall means for engagement with said flange inner edge thereon in said dispensing position.

15. The condiment shaker of claim 14 including retaining means for retaining said lid in each of said dispensing and closed positions, said retaining means comprising a recess and an aligned complementary projection, one on said flange and one on said wall means, said projection being releasably received in said recess in said dispensing position and thereby defining said retaining means for selectively retaining said lid in said dispensing position.

16. The condiment shaker of claim 15 wherein said projection is on said wall means, a portion of said inner edge of said flange aligning with said projection and engaging thereon in said closed position to define said retaining means for selectively retaining said lid in said closed position.

17. The condiment shaker of claim 1 wherein said body has an exterior surface, said wall means projecting inward of said exterior surface, said top panel including exterior surfaces respectively coextensive with said lid dispensing and pressure sections, said top panel exterior surfaces being alternately coplanar with said exterior surface of said body in said dispensing and closed positions of said lid.

18. A condiment shaker comprising a hollow body adapted to contain a condiment for selective dispensing thereof, said body including an exterior and an interior, an opening defined through said body from said exterior to said interior, a lid received within said opening, said lid including a top panel generally coextensive with said opening, and a peripheral flange depending from said top panel and terminating in an inner edge, said lid being received within said opening in sufficiently close peripheral proximity thereto to substantially preclude discharge of shaker contents between said lid and said opening, said lid including a dispensing section and a pressure section extending from said dispensing section and defining a pivot line therebetween, a first portion of said lid flange, within said dispensing section, including dispensing aperture means defined therein between said inner edge and said top panel, and pivot means mounting said lid in said opening for pivotal movement along said pivot line of said lid between a dispensing position and a closed position; said dispensing aperture means in said dispensing position of said lid being positioned at least partially outward of said exterior of said hollow body and said opening and defining a through passage outward from said interior to said exterior of said hollow body for a dispensing of a condiment therefrom, said lid flange peripherally beyond said first portion being in substantially sealed engagement with said opening; said dispensing aperture means in said closed position of said lid being positioned inward of said body exterior to preclude dispensing through said aperture means.

19. The condiment shaker of claim 18 wherein said aperture means comprises a plurality of peripherally spaced slots opening through said inner edge of said lid flange, and a plurality of lugs projecting inwardly from said opening, one in alignment with and receivable in each of said slots, said slots receiving said lugs therein in said closed position of said lid, and at least partially retracting from said lugs in said dispensing position.

20. The condiment shaker of claim 19 including retaining means for releasably retaining said lid in each of said dispensing and closed positions, and positioning means for locating said lid in each of said dispensing and closed positions.

21. The condiment shaker of claim 20 wherein said top panel includes an exterior surfaces respectively coextensive with said lid dispensing and pressure sections, said top panel exterior surfaces being alternately coplanar with said exterior surface of said body in said dispensing and closed positions of said lid.

22. The condiment shaker of claim 18 wherein said top panel includes exterior surfaces respectively coextensive with said lid dispensing and pressure sections, said top panel exterior surfaces being alternately coplanar with said exterior surface of said body in said dispensing and closed positions of said lid.

* * * * *